United States Patent [19]

Mougin et al.

[11] Patent Number: 5,070,937

[45] Date of Patent: Dec. 10, 1991

[54] INTERNALLY ENHANCED HEAT TRANSFER TUBE

[75] Inventors: Louis J. Mougin, La Crosse; Floyd C. Hayes, Onalaska, both of Wis.

[73] Assignee: American Standard Inc., New York, N.Y.

[21] Appl. No.: 660,330

[22] Filed: Feb. 21, 1991

[51] Int. Cl.[5] ..... F28F 1/40

[52] U.S. Cl. ..... 165/133; 165/179; 138/38

[58] Field of Search ..... 165/133, 179, 181, 177; 138/38

[56] References Cited

U.S. PATENT DOCUMENTS

| | | | |
|---|---|---|---|
| 3,684,007 | 8/1972 | Ragi | 165/133 |
| 3,861,462 | 1/1975 | McLain | 165/179 |
| 3,885,622 | 5/1975 | McLain | 165/179 |
| 3,902,552 | 9/1975 | McLain | 165/179 |
| 4,044,797 | 8/1977 | Fujie et al. | 165/179 |
| 4,216,826 | 8/1980 | Fujikake | 165/133 |
| 4,223,539 | 9/1980 | Webb et al. | 165/179 |
| 4,245,695 | 1/1981 | Fujikake | 165/133 |
| 4,314,587 | 2/1982 | Hackett | 138/38 |
| 4,330,036 | 5/1982 | Satoh et al. | 165/179 |
| 4,402,359 | 9/1983 | Carnavos et al. | 165/70 |
| 4,425,942 | 1/1984 | Hage et al. | 165/133 |
| 4,621,953 | 11/1986 | McGuth | 138/39 |
| 4,658,892 | 4/1987 | Shinohara et al. | 165/133 |
| 4,660,630 | 4/1987 | Cunningham et al. | 165/133 |
| 4,660,630 | 4/1987 | Cunningham et al. | 165/133 |
| 4,700,771 | 10/1987 | Bennett et al. | 165/133 |
| 4,715,436 | 12/1987 | Takahashi et al. | 165/133 |
| 4,733,698 | 3/1988 | Sato | 138/38 |
| 4,760,710 | 8/1988 | Takagi | 165/133 |
| 4,794,983 | 1/1989 | Yoshida et al. | 165/133 |
| 4,880,054 | 11/1989 | Yoshida et al. | 165/133 |

FOREIGN PATENT DOCUMENTS

| | | | |
|---|---|---|---|
| 565027 | 10/1944 | United Kingdom | 165/179 |
| 914810 | 1/1963 | United Kingdom | 165/133 |

*Primary Examiner*—John Rivell
*Assistant Examiner*—L. R. Leo
*Attorney, Agent, or Firm*—William J. Beres; William O'Driscoll

[57] ABSTRACT

An internally enhanced heat transfer tube comprising a heat transfer tube including an internal surface and an internal diameter (D); a plurality of roughness elements on the internal surface of the heat transfer tube, each roughness element having a height (e) above the internal surface where the ratio of the height (e) to the internal diameter (D) falls within the range $0.004 \leqq e/D \leqq 0.045$.

33 Claims, 3 Drawing Sheets

FIG. 4c
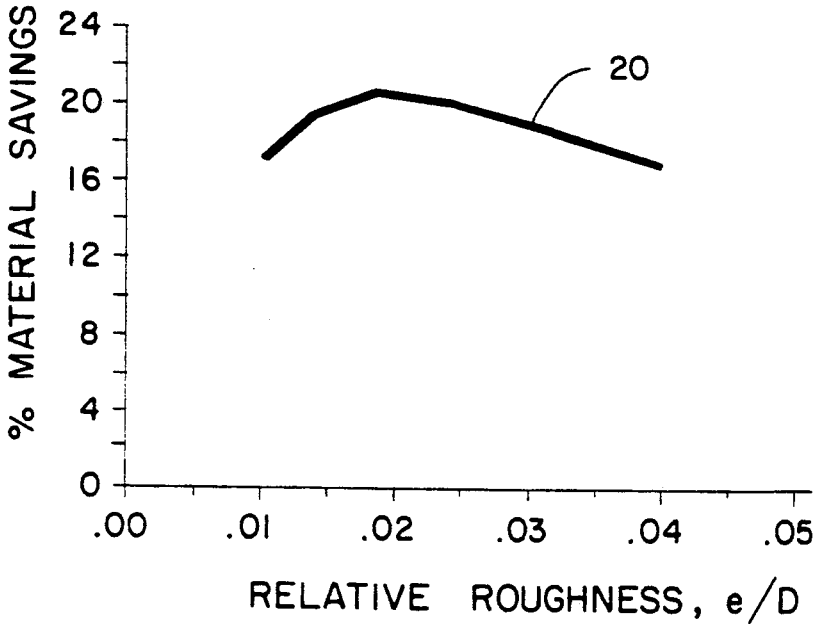
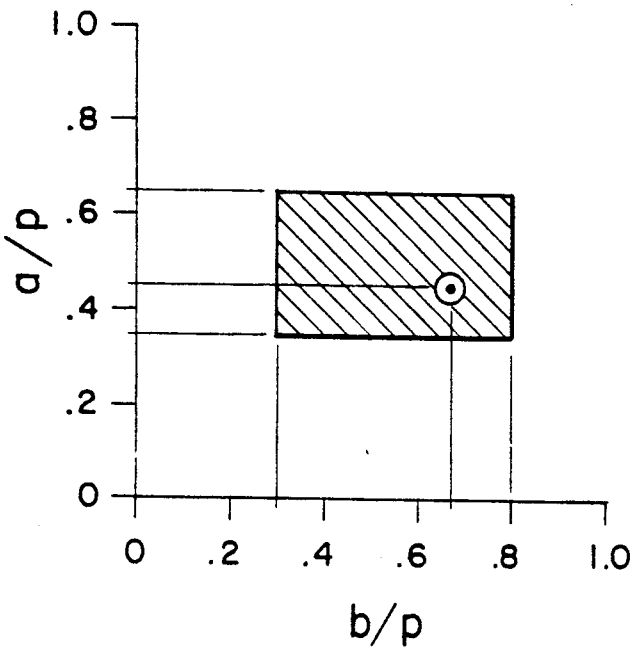
FIG. 5

INTERNALLY ENHANCED HEAT TRANSFER TUBE

BACKGROUND OF THE INVENTION

The present invention is directed to internally enhanced heat transfer tubes, and more particularly, to an arrangement of roughness elements on the internal surface of the heat transfer tube which provides more efficient and economical heat transfer.

It is highly desirable to limit the material content of the heat transfer tube, particularly as the material in the roughness elements increases the cost of the heat transfer tube. On the other hand, the size, shape and spacing of the roughness elements can be optimized to maximize heat transfer efficiency for all types of tubing used in refrigeration systems. The enhancements, such as roughness elements, on the internal surface of a heat transfer tube are typically formed by deformation of material. Previous internal enhancement arrangements have not optimally maximized heat transfer efficiency while minimizing material content.

For example, U.S. Pat. Nos. 4,794,983 and 4,880,054 show projected parts having cavities on the inner wall surface of a tubular body. The ratio of the interval (P) between the projected parts and the height (e) of the projected parts must satisfy the equation $10 \leqq P/H \leqq 20$.

U.S. Pat. No. 4,402,359 shows pyramid fins formed integrally on the outer surface of a cylindrical tube. The preferred height of the pyramid fins is about 0.022 inches at 20 threads per inch.

U.S. Pat. No. 3,684,007 shows a smooth, flat surface having a multiplicity of discrete raised sections in the general shape of pyramids.

U.S. Pat. No. 4,216,826 is an example of an external tube surface including thin walled fins of rectangular cross-section which are about 0.1 millimeters thick and about 0.25 millimeters high.

U.S. Pat. No. 4,245,695 shows the external surface of a heat transfer tube including pyramid like raised sections with a cylindrical shape. In an experimental example this patent describes a "circular pitch" of 1.41 millimeter and a 0.75 millimeter height for the raised parts.

U.S. Pat. No. 4,733,698 shows a complex internal groove arrangement which includes projecting portions having a triangular cross-section.

U.S. Pat. No. 4,715,436 shows a row of projections regularly spaced on the inner surface of a heat transfer tube. Each projection is composed of a smooth curved surface formed by external deformation of the tube walls. The smallest pitch to height ratio shown is 5.6 ($Z/E=2.45/0.45$).

U.S. Pat. No. 4,330,036 is similar to the '436 patent in showing a number of beads on the internal surface of a heat transfer pipe.

U.S. Pat. Nos. 4,660,630 and 4,658,892 are examples of internally finned tubes showing spiral grooves separated by continuous ridges.

SUMMARY OF THE INVENTION

It is an object, feature and advantage of the present invention to solve the problems in prior art internally enhanced heat transfer tubes.

It is an object, feature and advantage of the present invention to optimize the heat transfer efficiency of an internally enhanced heat transfer tube while minimizing the material content of the tube.

It is an object, feature and advantage of the present invention to provide optimal roughness pattern for internal enhanced heat transfer tubes.

The present invention provides an internally enhanced heat transfer tube comprising a heat transfer tube including an internal surface and an internal diameter (D). The heat transfer tube includes a plurality of roughness elements on the internal surface of the heat transfer tube. Each roughness element has a height (e) above the internal surface where the ratio of the height (e) to the internal diameter (D) falls within the range $0.004 \leqq e/D \leqq 0.045$.

The present invention provides an internally enhanced heat transfer tube comprising a heat transfer tube including an internal surface and an internal diameter (D). The heat transfer tube includes a plurality of spaced roughness elements on the internal surface of the heat transfer tube. Each roughness element has a height (e) above the internal surface and being spaced from the adjoining roughness elements a pitch (P) where the ratio of the pitch (P) to the height (e) falls within the range $2.5 \leqq P/e \leqq 5.0$.

The present invention provides an internally enhanced heat transfer tube comprising: a heat transfer tube including an internal surface and an internal diameter (D). The heat transfer tube includes a plurality of uniformly spaced roughness elements on the internal surface of the heat transfer tube. Each roughness element has a height (e) above the internal surface, a top width (a), a base width (b), and side wall slope (s), and each roughness element being spaced from the adjacent roughness elements a pitch (P). The ratio of the top width (a) to the base width (b) falls within the range $0.35 \leqq a/b \leqq 0.65$, the ratio of the base width (b) to the pitch (P) falls within the range $0.3 \leqq b/P \leqq 0.8$, and the side wall slope (s) is defined by $\tan s = 2e/(b-a)$.

The present invention provides an internally enhanced heat transfer tube including an internal surface and an internal diameter (D). The heat transfer tube includes a plurality of spaced roughness elements on the internal surface of the heat transfer tube. Each roughness element has a height (e) above the internal surface where the ratio of the height (e) to the internal diameter (D) falls within the range $0.004 \leqq e/D \leqq 0.045$. Each roughness element is spaced from the adjacent roughness elements a pitch (P) where the ratio of the pitch (P) to the height (e) falls within the range $2.5 \leqq P/e \leqq 5.0$. Each roughness element has a top width (a), a base width (b), and a side wall slope (s) where the ratio of the top width (a) to the base width (b) falls within the range $0.35 \leqq a/b \leqq 0.65$, the ratio of the base width (b) to the pitch (P) falls within the range $0.3 \leqq b/P \leqq 0.8$, and the side wall slope (s) is defined by $\tan s = 2e/(b-a)$.

The present invention provides an internally enhanced heat transfer tube comprising a heat transfer tube including an internal surface and an internal diameter (D). The heat transfer tube includes a plurality of spaced roughness elements on the internal surface of the heat transfer tube. Each roughness element has a height (e) above the internal surface where the ratio of the height (e) to the internal diameter (D) falls within the range $0.004 \leqq e/D \leqq 0.045$. Each roughness element is spaced from the adjacent roughness element a pitch (P) where the ratio of the pitch (P) to the height (e) falls within the range $2.5 \leqq P/e \leqq 5.0$.

The present invention provides an internally enhanced heat transfer tube comprising a heat transfer tube including an internal surface and an internal diameter (D). The heat transfer tube includes a plurality of spaced roughness elements on the internal surface of the heat transfer tube. Each roughness element has a height (e) above the internal surface where the ratio of the height (e) to the internal diameter (D) falls within the range $0.004 \leqq e/D \leqq 0.045$. Each roughness element has a top width (a), a base width (b), and a side wall slope (s). Each roughness element is spaced from the adjacent roughness elements a pitch (P), where the ratio of the top width (a) to the base width (b) falls within the range $0.35 \leqq a/b \leqq 0.65$, the ratio of the base width (b) to the pitch (P) falls within the range $0.3 \leqq b/P \leqq 0.8$, and the side wall slope is defined by $\tan s = 2e/(b-a)$.

The present invention provides an internally enhanced heat transfer tube comprising: a heat transfer tube including an internal surface and an internal diameter (D). The heat transfer tube includes a plurality of spaced roughness elements on the internal surface of the heat transfer tube. Each roughness element has a height (e) above the internal surface, a top width (a), a base width (b), and a side wall slope (s). Each roughness element is spaced from the adjacent roughness elements a pitch (P) where the ratio of the pitch (P) to the height (e) falls within the range $2.5 \leqq P/e \leqq 5.0$, where the ratio of the top width (a) to the base width (b) falls within the range $0.35 \leqq a/b \leqq 0.65$, the ratio of the base width (b) to the pitch (P) falls within the range $0.3 \leqq b/P \leqq 0.8$, and the side wall slope is defined by $\tan s = 2e/(b-a)$.

BRIEF DESCRIPTION OF THE DRAWINGS

FIG. 4(*b*) is an empirically determined graph showing the relationship of material savings to relative roughness for a chiller evaporator and a chiller condenser.

FIG. 4(*c*) is an empirically determined graph showing the relationship of material savings to relative roughness for a chilled water coil.

FIG. 5 is a empirically determined graph showing the optimal relationship of shape to spacing for the roughness elements of FIGS. 2 and 3.

DETAILED DESCRIPTION OF THE DRAWINGS

Figure 1:
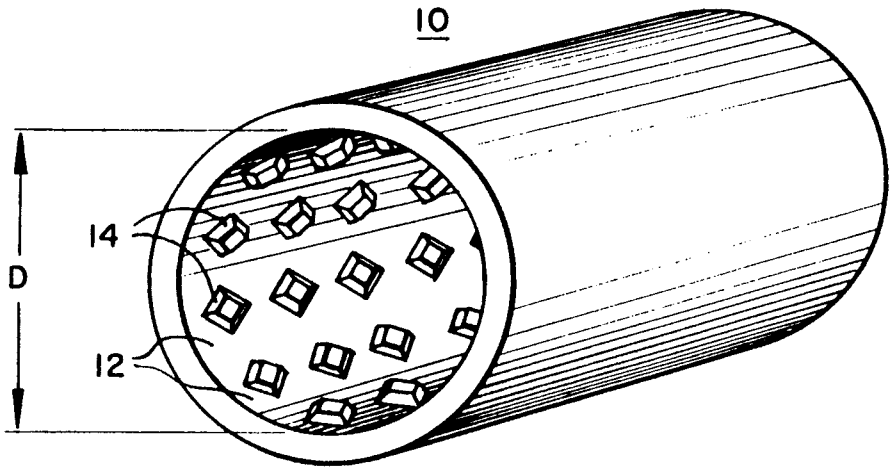
FIG. 1 shows a perspective view of an internally enhanced heat transfer tube.

FIG. 1 shows an internally enhanced heat transfer tube 10 such as might be used for heat transfer between two fluids in an evaporator, in a condenser, in a chilled water coil, in a shell and tube evaporator, or in a shell and tube condenser of a refrigeration system. Other heat transfer applications are also contemplated.

The heat transfer tube 10 has a longitudinal axis, an internal diameter D and an internal surface 12. Roughness elements 14 are located on the internal surface 12 to facilitate heat transfer between the internal surface 12 and a heat transfer fluid flowing within the heat transfer tube 10. The size, spacing, shape and proportions of the roughness elements 14 in relation to the internal diameter D and to adjacent roughness elements 14 determines the relative roughness of the internal surface 12.

Figure 2:
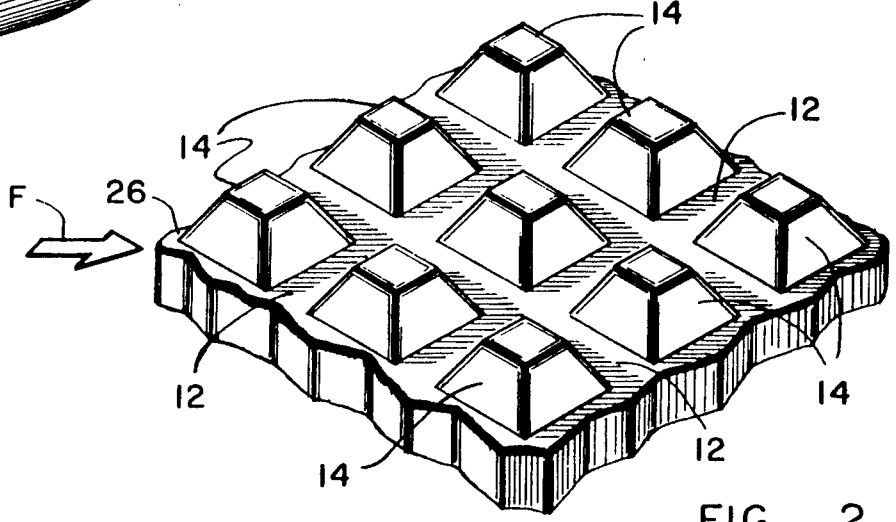
FIG. 2 shows an optimal arrangement of the roughness elements of the present invention for use in the tube of FIG. 1.

The roughness elements 14 are formed by deforming material from the internal surface 12 of the heat transfer tube 10 in such a manner as to leave only roughness elements 14 projecting above the internal surface 12. The formation of the roughness elements 14 can be accomplished in a number of ways including the processes shown in U.S. Pat. Nos. 3,861,462; 3,885,622; and 3,902,552, which are herein incorporated by reference. In these processes the roughness elements 14 are formed on a flat sheet such as is shown in FIG. 2 and then rolled into the tube 10 of FIG. 1. The size of the roughness elements 14 relative to the internal diameter D of the heat transfer tube 10 is such that FIGS. 2 and 3 also represent the internal surface 12 of the heat transfer tube 10.

Figure 3:
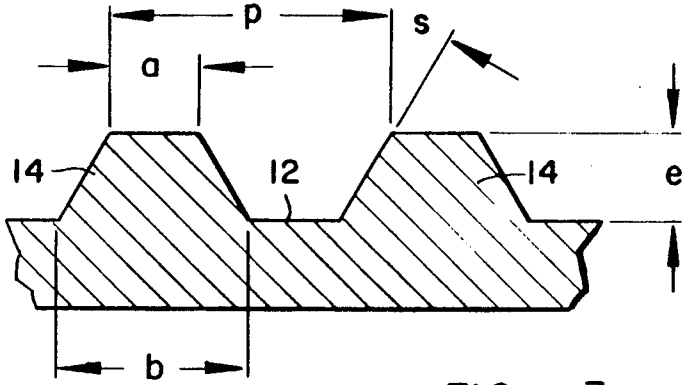
FIG. 3 is an enlarged view of several of the roughness elements of FIG. 2.

After formation, as shown in FIG. 3, each roughness element 14 projects from the internal surface 12 a height (e). In the preferred embodiment each roughness element 14 is uniformly spaced from the adjacent roughness elements 14 and each roughness element 14 is shaped as a flat topped pyramid. The flat topped pyramid is preferred because it can be easily formed with one pass of a tube knurler. Of course, other shapes falling within the relationships described herein are also contemplated.

Figure 4A:
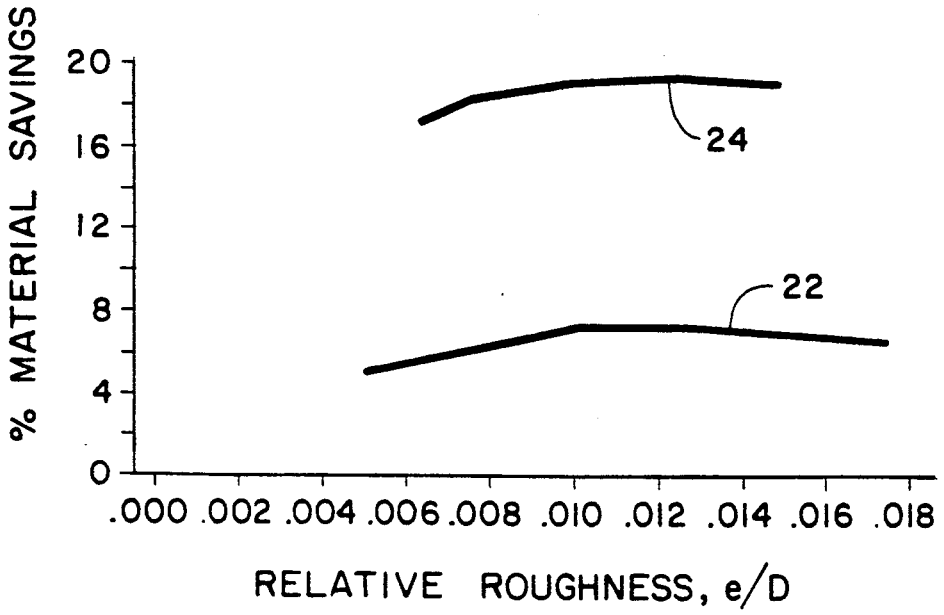
FIG. 4(*a*) is an empirically determined graph showing the relationship of material savings to relative roughness for a condenser and an evaporator.
Figure 4B:
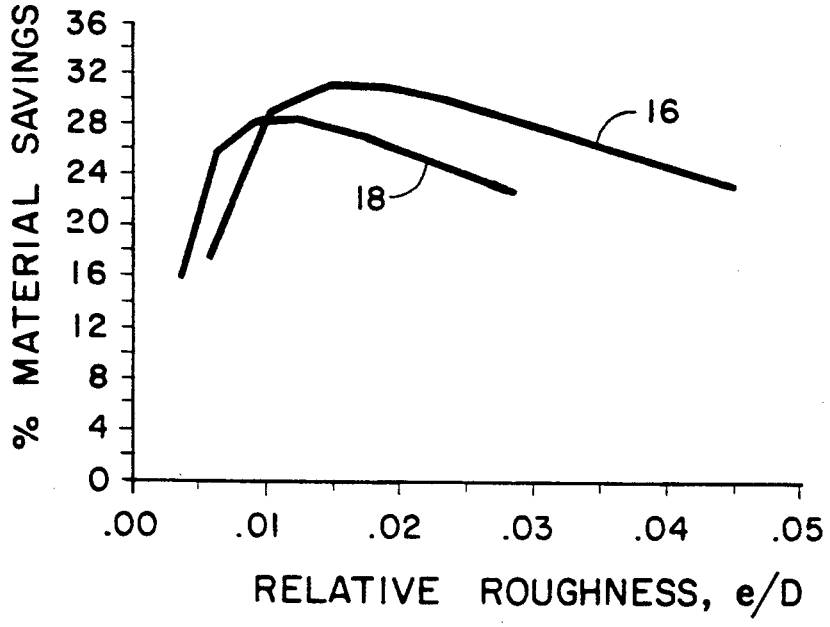

The height (e) of each roughness element 14 is such that the ratio of the height (e) to the internal diameter D falls within the range $0.004 \leqq e/D \leqq 0.045$. The basis for this range can be seen in the graph of material savings versus relative roughness shown in FIG. 4(*a*), (*b*) and (*c*). These graphs show material savings versus relative roughness for a chiller evaporator 16, a chiller condenser 18, a chilled water coil 20, a condenser 22 and an evaporator 24. From this it can be seen that the optimal height (e) to internal diameter D ratio for all heat exchanger tubing 10 fall within the range 0.011 to 0.019 with specific optimum ratios of 0.0125 for the evaporator coil, 0.0125 for the condenser coil, 0.019 for the chilled water coil, 0.015 for the shell and tube evaporator coil, and 0.011 for the shell and tube condenser coil. Material savings represents the savings in heat exchange tubing material for a given heat transfer application relative to a smooth internal heat transfer tubing surface which has the same heat transfer application and the same minimum tube wall thickness so as to provide the same burst pressure.

As shown in FIG. 3, the uniform spacing of the roughness elements 14 on the internal surface 12 is determined by the pitch P between arbitrary but corresponding points on adjacent roughness elements 14. The pitch P is such that the ratio of the pitch P to the height (e) falls within the range $2.5 \leqq P/e \leqq 5.0$ with a preferred pitch (P) to height ratio of 3.0.

The shape of the roughness element 14 is also optimized as shown in the graph of FIG. 5 where an optimal roughness element top width (a) to base width (b) ratio of 0.45 is optimal within a preferred range of 0.35 to 0.65, and a roughness element base width (b) to pitch (P) ratio of 0.67 is optimal within a preferred range of 0.3 to 0.8. Also, a roughness element side wall slope (s) is uniquely defined by $\tan s = 2e/(b-a) = 2/[(b/P)(P/e)(1-a/b)]$, preferably with an optimal side wall slope of approximately 32°.

Finally, in the preferred embodiment, one of the corners 26 of each pyramidically shaped roughness element 14 preferably points in the direction of the flow of the heat transfer fluid as is shown in FIG. 2 by arrow F.

What has been described is an interally enhanced heat transfer tube which optimizes heat transfer. It should be recognized that modifications and alterations of the present invention as described herein are possible. Such modifications include changing the shape of the preferred flat topped pyramid to other geometrical shapes within the claimed constraints. Additionally, the uniform spacing described in connection with the preferred embodiment could be modified to uniform spacing in a single dimension as compared to the two dimensional spacing illustrated in FIG. 2. All such modifications and alterations are intended and contemplated to be within the spirit and scope of the present invention.

What is desired to be secured by Letters Patent of the United States is claimed as follows:

1. An internally enhanced heat transfer tube comprising:

a heat transfer tube including an internal surface and an internal diameter (D);

a plurality of roughness elements on the internal surface of the heat transfer tube, each roughness element having a height (e) above the internal surface where the ratio of the height (e) to the internal diameter (D) falls within the range $0.004 \leqq e/D \leqq 0.045$ wherein each roughness element is shaped as a flat topped pyramid.

2. The heat transfer tube of claim 1 wherein the ratio of the height (e) to the internal diameter (D) falls within the range $0.011 \leqq e/D \leqq 0.019$.

3. The heat transfer tube of claim 2 wherein the ratio of the height (e) to the internal diameter (D) is approximately equal to 0.0125.

4. The heat transfer tube of claim 2 wherein the ratio of the height (e) to the internal diameter (D) is approximately equal to 0.019.

5. The heat transfer tube of claim 2 wherein the ratio of the height (e) to the internal diameter (D) is approximately equal to 0.015.

6. The heat transfer tube of claim 2 wherein the ratio of the height (e) to the internal diameter (D) is approximately equal to 0.011.

7. The heat transfer tube of claim 1 wherein the roughness elements are uniformly spaced.

8. The heat transfer tube of claim 1 wherein each roughness element is spaced from the adjoining roughness element a pitch (P) where the ratio of the pitch (P) to the height (e) falls within the range $2.5 \leqq P/e \leqq 5.0$.

9. The heat transfer tube of claim 8 wherein the ratio of the pitch (P) to the height (e) is approximately 3.0.

10. The heat transfer tube of claim 1 wherein each roughness element is shaped with a top width (a), a base width (b) and a side wall slope (s) where the ratio of the top width (a) to the base width (b) falls within the range $0.35 \leqq a/b$ which $\leqq 0.65$, the ratio of the base width (b) to the pitch (P) falls within the range $0.3 \leqq b/P \leqq 0.8$, and the side wall slope (s) defined by $\tan s = 2e/(b-a)$.

11. The heat transfer tube of claim 10 wherein each roughness element includes a corner which points in the direction of fluid flow within the heat transfer tube.

12. The heat transfer tube of claim 1 wherein the ratio of height (e) to the internal diameter (D) falls within the range $0.004 \leqq e/D \leqq 0.019$.

13. The heat transfer tube of claim 1 wherein the ratio of the height (e) to the internal diameter (D) falls within the range $0.011 \leqq e/D \leqq 0.045$.

14. An internally enhanced heat transfer tube comprising:

a heat transfer tube including an internal surface and an internal diameter (D);

a plurality of spaced roughness elements on the internal surface of the heat transfer tube, each roughness element having a height (e) above the internal surface and being spaced from the adjoining roughness elements a pitch (P) where the ratio of the pitch (P) to the height (e) falls within the range $2.5 \leqq P/e \leqq 5.0$ wherein each roughness element has a flat topped pyramidical shape having a top width (a), a base width (b) and a side wall slope (s) where the ratio of the top width (a) to the base width (b) is approximately equal to 0.45, the ratio of the base width (b) to the pitch (P) is approximately equal to 0.67, and the wide wall slope (s) is defined by $\tan s = 2e/(b-a)$.

15. The heat transfer tube of claim 14 wherein the ratio of the pitch (P) to the height (e) is approximately equal to 3.0.

16. The heat transfer tube of claim 14 wherein the ratio of the height (e) to the internal diameter (D) falls within the range $0.011 \leqq e/D \leqq 0.019$.

17. An internally enhanced heat transfer tube comprising:

a heat transfer tube including an internal surface and an internal diameter (D);

a plurality of uniformly spaced roughness elements on the internal surface of the heat transfer tube, each roughness element having a height (e) above the internal surface, a top width (a), a base width (b), and a side wall slope (s) and each roughness element being spaced from the adjacent roughness elements a pitch (P) where the ratio of the top width (a) to the base width (b) falls within the range $0.35 \leqq a/b \leqq 0.65$, the ratio of the base width (b) to the pitch (P) falls within the range $0.3 \leqq b/P \leqq 0.8$, and the side wall slope (s) is defined by $\tan s = 2e/(b-a)$.

18. The heat transfer tube of claim 17 wherein the ratio of the top width (a) to the base width (b) is approximately equal to 0.45.

19. The heat transfer tube of claim 17 wherein the ratio of the base width (b) to the pitch (P) is approximately equal to 0.67.

20. The heat transfer tube of claim 17 wherein each roughness element includes a corner which points into the flow of the heat transfer fluid within the heat transfer tube.

21. The heat transfer tube of claim 17 wherein the ratio of the height (e) to the internal diameter (D) falls within the range $0.011 \leqq e/D \leqq 0.019$.

22. The heat transfer tube of claim 17 wherein each roughness element is spaced from the adjoining roughness element a pitch (P) where the ratio of the pitch (P) to the height (e) falls within the range $2.5 \leqq P/e \leqq 0.65$.

23. An internally enhanced heat transfer tube comprising:

a heat transfer tube including an internal surface and an internal diameter (D);

a plurality of spaced roughness elements on the internal surface of the heat transfer tube, each roughness element having a height (e) above the internal surface where the ratio of the height (e) to the internal diameter (D) falls within the range $0.004 \leqq e/D \leqq 0.045$;

each roughness element being spaced from the adjacent roughness elements a pitch (P) where the ratio of the pitch (P) to the height (e) falls within the range $2.5 \leqq P/e \leqq 5.0$; and each roughness element having a top width (a), a base width (b), and a side wall slope (s) where the ratio of the top width (a) to the base width (b) falls within the range $0.35 \leqq a/b \leqq 0.65$, the ratio of the base width (b) to the pitch (P) falls within the range $0.3 \leqq b/P \leqq 0.8$, and the side wall slope (s) is defined by $\tan s = 2e/(b-a)$.

24. The heat transfer tube of claim 23 wherein each roughness element is uniformly spaced from the adjacent roughness elements, and each roughness element has a pyramidical shape.

25. The heat transfer tube of claim 23 wherein the ratio of the height (e) to the internal diameter (D) falls within the range $0.011 \leqq e/D \leqq 0.019$, the ratio of the pitch (P) to the height (e) is approximately equal to 3, the ratio of the top width (a) to the base width (b) is approximately equal to 0.45, and the ratio of the base width (b) to the pitch (P) is approximately equal to 0.67.

26. An internally enhanced heat transfer tube comprising:

a heat transfer tube including an internal surface and an internal diameter (D);

a plurality of spaced roughness elements on the internal surface of the heat transfer tube, each roughness element having a height (e) above the internal surface where the ratio of the height (e) to the internal diameter (D) falls within the range $0.004 \leqq e/D \leqq 0.045$, and each roughness element being spaced from the adjacent roughness element a pitch (P) where the ratio of the pitch (P) to the height (e) falls within the range $2.5 \leqq P/e \leqq 5.0$ wherein each roughness element has a flat topped pyramidical shape having a top width (a), a base width (b) and a side wall slope (s) where the ratio of the top width (a) to the base width (b) falls within the range $0.35 \leqq a/b \leqq 0.65$, the ratio of the base width (b) to the pitch (P) falls within the range $0.3 \leqq b/P \leqq 0.8$, and the side wall slope is defined by $\tan s = 2e/(b-a)$.

27. The heat transfer tube of claim 26 wherein the ratio of the height (e) to the internal diameter (D) falls within the range $0.011 \leqq e/D \leqq 0.019$.

28. An internally enhanced heat transfer tube comprising:

a heat transfer tube including an internal surface and an internal diameter (D);

a plurality of spaced roughness elements on the internal surface of the heat transfer tube, each roughness element having a height (e) above the internal surface where the ratio of the height (e) to the internal diameter (D) falls within the range $0.004 \leqq e/D \leqq 0.045$, each roughness element having a top width (a), a base width (b), and a side wall slope (s), and each roughness element being spaced from the adjacent roughness elements a pitch (P) where the ratio of the top width (a) to the base width (b) falls within the range $0.35 \leqq a/b \leqq 0.65$, and the ratio of the base width (b) to the pitch (P) falls within the range $0.3 \leqq b/P \leqq 0.8$, and the side wall slope is defined by $\tan s = 2e/(b-a)$.

29. The heat transfer tube of claim 28 wherein the ratio of the height (e) to the internal diameter (D) falls within the range $0.011 \leqq e/D \leqq 0.019$.

30. The heat transfer tube of claim 28 wherein each roughness element is uniformly spaced from the adjacent roughness elements.

31. An internally enhanced heat transfer tube comprising:

a heat transfer tube including an internal surface and an internal diameter (D);

a plurality of spaced roughness elements on the internal surface of the heat transfer tube, each roughness element having a height (e) above the internal surface, a top width (a), a base width (b), and a side wall slope (s) and each roughness element being spaced from the adjacent roughness elements a pitch (P) where the ratio of the pitch (P) to the height (e) falls within the range $2.5 \leqq P/e \leqq 5.0$, where the ratio of the top width (a) to the base width (b) falls within the range $0.35 \leqq a/b \leqq 0.65$, the ratio of the base width (b) to the pitch (P) falls within the range $0.3 \leqq b/P \leqq 0.8$, and the side wall slope is defined by $\tan s = 2e/(b-a)$.

32. The heat transfer tube of claim 31 wherein the ratio of the top width (a) to the base width (b) is approximately 0.45, the ratio of the base width (b) to the pitch (P) is approximately 0.67, and the ratio of the pitch (P) to the height (e) is approximately 3.

33. The heat transfer tube of claim 31 wherein the ratio of the height (e) to the internal diameter (D) falls within the range $0.011 \leqq e/D \leqq 0.019$.

* * * * *